United States Patent [19]

Tsujii et al.

[11] 4,277,378

[45] Jul. 7, 1981

[54] DETERGENT COMPOSITIONS CONTAINING PARTIALLY NEUTRALIZED ALKYL OR ALKENYL SUCCINIC ACID

[75] Inventors: Kaoru Tsujii, Utsunomiya; Naoyuki Saito; Michio Kawai, both of Ichikaimachi, all of Japan

[73] Assignee: Kao Soap Co., Ltd., Tokyo, Japan

[21] Appl. No.: 136,621

[22] Filed: Apr. 2, 1980

[30] Foreign Application Priority Data

Apr. 20, 1979 [JP] Japan ..... 54-48835

[51] Int. Cl.[3] ..... C11D 1/04

[52] U.S. Cl. ..... 252/546; 252/89.1; 252/142; 252/174.19

[58] Field of Search ..... 252/174.19, 142, 546, 252/89.1; 562/590

[56] References Cited

U.S. PATENT DOCUMENTS

| | | | |
|---|---|---|---|
| 2,283,214 | 5/1942 | Kyrides | 562/595 |
| 2,360,426 | 10/1944 | Kyrides | 562/595 |
| 3,271,310 | 9/1966 | La Suer | 252/35 |
| 3,579,453 | 5/1971 | Dupre et al. | 252/174.19 |
| 3,725,286 | 4/1973 | Pettigrew | 562/595 |

FOREIGN PATENT DOCUMENTS

| | | | |
|---|---|---|---|
| 2296683 | 9/1976 | France | 252/174.19 |
| 34904 | 3/1974 | Japan | 252/174.19 |
| 1411376 | 10/1975 | United Kingdom | 562/590 |

*Primary Examiner*—P. E. Willis, Jr.

*Attorney, Agent, or Firm*—Blanchard, Flynn, Thiel, Boutell & Tanis

[57] ABSTRACT

An alkaline builder-free detergent composition contains a partially neutralized succinic acid derivative of the formula (1):

(1)

wherein R is a saturated or unsaturated hydrocarbon group of 8–18 carbon atoms, and X and Y each are hydrogen, an alkali metal, ammonium or an alkanolamine, characterized in that when the composition is diluted with water thereby to give a succinic acid derivative content of 0.5 wt. %, the solution has a pH of 5.5–8.0.

7 Claims, No Drawings

DETERGENT COMPOSITIONS CONTAINING PARTIALLY NEUTRALIZED ALKYL OR ALKENYL SUCCINIC ACID

BACKGROUND OF THE INVENTION

1. Field of the Invention

The present invention relates to a detergent composition. More particularly, the present invention relates to an alkaline builder-free detergent composition having an excellent detergency against oils and fats and foaming power in the presence of oils and fats, a high foam-removing property during the rinsing step and, furthermore, a low irritation to the skin.

2. Description of the Prior Art

Surfactants used as detergent bases in the field of detergents for tablewares and kitchen appliances and shampoos are anionic surfactants such as straight chain alkylbenzenesulfonates (LAS), alkylsulfuric acid ester salts (AS), polyoxyethylene alkyl ether sulfuric acid ester salts (ES) and alkylsulfonic acid salts (PS); and nonionic surfactants such as polyoxyethylene alkyl (or alkylphenyl) ethers. However, the anionic surfactants generally lack mildness to the skin and they roughen hands, although they have excellent detergency and foaming properties.

Soaps and acylglutamic acid salts, which are long chain fatty acid salts, have been used as anionic surfactants which cause relatively small roughening of hands. However, their detergency and foaming power, which is are indispensable for the detergent, are still insufficient. Further, nonionic surfactants are unsatisfactory as detergent bases in this field for the same reasons as above. Under the circumstances as above, the development of a surfactant which is mild to the skin and usable as a detergent base having an excellent detergency and foaming power is now desired earnestly.

SUMMARY OF THE INVENTION

After intensive investigations on a surfactant which has an excellent detergency and foaming power and which is mild to the skin, the present inventors have found that partially neutralized succinic acid derivatives have the above-mentioned properties. The present invention has been attained on the basis of this finding.

The present invention provides an alkaline builder-free detergent composition containing a partially neutralized succinic acid derivative of the formula (1):

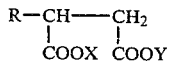

(1)

wherein R is a saturated or unsaturated hydrocarbon group having 8–18 carbon atoms, preferably 10–16 carbon atoms, and X and Y each are hydrogen, an alkali metal, ammonium or an alkanolamine, characterized in that when said composition is diluted with water thereby to give a succinic acid derivative content of 0.5 wt. %, it has a pH of 5.5–8.0.

It is known to provide succinic acid derivatives in heavy duty detergents containing an alkali builder. For example, succinic acid salt substituted with an aliphatic hydrocarbon of 4–14 carbon atoms is disclosed as a solubilizer for the liquid heavy duty detergent composition, in the specification of Japanese Patent Laid-Open No. 142,603/1975, and the disodium salt of n-decane-1,2-dicarboxylic acid is disclosed as a bulider to be used in place of a tripolyphosphoric acid salt, in the specification of Japanese Patent Publication No. 35330/1973. But all of the succinic acid derivatives used in those prior arts are completely neutralized and, in addition, they serve as only an adjuvant ingredient in the detergent. No prior art suggests such an effect of the partially neutralized succinic acid derivatives as provided in the present invention.

The detergent composition according to the present invention has an excellent detergency and also an excellent foaming power in the presence of oils. It furthermore has a mild effect to the skin.

Partially neutralized succinic acid derivative of the formula (1) is incorporated in the detergent composition in an amount of 3 to 95 wt. % based on the weight of the composition. When the composition is in the form of liquid, it is preferred that the partially neutralized succinic acid derivative content is 3 to 50 wt. %, more preferably 10–40 wt. %. In the case of the solid detergent, it comprises the partially neutralized succinic acid derivative in an amount of 30 to 95 wt. %, preferably 35 to 90 wt. %, based on the weight of the detergent composition. According to the present invention, if the detergent composition is diluted to such an extent that succinic acid derivative content is 0.5 wt. %, the aqueous solution should have a pH of 5.5–8.0, preferably 6.0–7.0.

The detergent composition of the present invention can be obtained by synthesizing a succinic acid derivative of the formula (1) having a neutralization degree of 0.2–0.9 and then adjusting the pH of an aqueous solution of the derivative with sodium hydroxide, potassium hydroxide, an aqueous ammonia or an alkanolamine, such as triethanolamine, monoethanolamine and monoisopropanolamine, or acid so that when the derivative is diluted with water to form the aqueous solution having a succinic acid derivative content of 0.5 wt. %, the pH of the solution may be in the range of 5.5–8.0. If a succinic acid derivative of a neutralization degree of 0.2–0.9 is synthesized, the subsequent step wherein the pH value is adjusted is easy.

As preferred succinic acid derivatives used in the present invention, there may be mentioned, for example, 2-decenylsuccinic acid, 2-dodecenylsuccinic acid, 2-tetradecenylsuccinic acid, 2-hexadecenylsuccinic acid, 2-octadecenylsuccinic acid, decyl(straight chain or branched)-succinic acid, dodecyl(straight chain or branched)succinic acid, tetradecyl (straight chain or branched)succinic acid, hexadecyl (straight chain or branched)succinic acid, octadecyl (straight chain or branched)succinic acid, oleylsuccinic acid and partial neutralization products (neutralization degree 0.2–0.9) of alkali metal salts, such as lithium salt, sodium salt and potassium salt, ammonium salt and $C_2$–$C_3$ alkanolamine salt of them. Among them, an alkenylsuccinic acid (salt) having a double bond in the hydrocarbon moiety is preferred.

The method of synthesizing a succinic acid derivative of the formula (1) is not particularly limited. It can be obtained by, for example, synthesizing an alkenylsuccinic anhydride from α-olefin and maleic anhydride as shown by the following reaction formula:

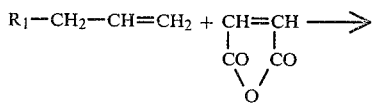

-continued

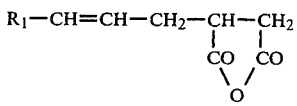

wherein $R_1$ is a hydrocarbon residue; then hydrolyzing the thus obtained alkenylsuccinic anhydride, further hydrolyzing the resulting product with an alkali which has ions corresponding to X and Y as defined in the formula (1) (such as sodium hydroxide, potassium hydroxide, monoethanolamine and ammonia) and neutralizing the hydrolysis product. The alkylsuccinic acid derivative can be obtained also by hydrogenating a corresponding alkenylsuccinic acid derivative.

As for the neutralization degree of a succinic acid derivative of the formula (1) to be used in the present invention, 0.2–0.9 equivalent of carboxyl group of the succinic acid derivative should be in the form of a salt and the remainder should be in the form of the acid. A succinic acid derivative which is beyond this range is unfavorable, since the foaming power of such a succinic acid derivative, is not improved in the presence of oils or fats.

The detergent composition of the present invention may be in the form of liquid, paste, solid or powder. From viewpoint of easiness of use, the liquid form is desirable. The detergent composition of the present invention is used mainly for washing tablewares and kitchen appliances. However, the uses thereof are not limited to the washing of tablewares and kitchen appliances but it is used also as a component of neutral detergents for clothes and shampoos.

The detergent composition of the present invention may contain additives in such an amount that does not disturb the effects of the present invention, in addition to partially neutralized succinic acid derivatives of the formula (1). The additives include anionic surfactants such as straight chain alkylbenzenesulfonic acid salts, alkylsulfuric acid ester salts, polyoxyethylene alkyl (or alkylphenyl) ether sulfuric acid ester salts, α-olefinsulfonic acid salts, alkylsulfonic acid salts, soaps and acylglutamic acid salts, nonionic surfactants such as polyoxyalkylene (preferably polyoxyethylene) alkyl (or alkylphenyl) ethers, polyoxyethylenesorbitan fatty acid esters, polyoxyethylene fatty acid esters, sucrose fatty acid esters and fatty acid alkylolamides; ampholytic surfactants such as alkylbetaines, alkylsulfobetaines and alkylamine oxides; solubilizers such as ethanol, isopropanol, propyleneglycol polypropyleneglycol, glycerol and sorbitol; neutral builders such as sodium sulfate; high molecular compounds for controlling viscosity; latexes used as suspending agents; perfumes; and dyes.

The following examples further illustrate the present invention, which by no means limit the invention.

Carbon numbers of the alkenyl or alkylsuccinic acids indicate carbon numbers of R in the formula (1). Concentrations are those calculated as acids.

EXAMPLE 1

The neutralization degrees of alkenyl ($C_{12}$) succinic acids were varied with sodium hydroxide, and the pH values and foaming powers of 0.5% aqueous solutions thereof were determined to obtain results shown in Table 1.

[Method of determination of foaming power]

A given amount of a detergent was dissolved in hard water of a hardness of 4° (German hardness). 100 Milliliters of the solution and 1 g of refined soybean oil were placed in a cylinder of a diameter of 64.5 mm. Then, a stirrer of automatic reversion type of 1300 rpm having four stirring blades of 50 mm length and 12 mm width was arranged just below the surface of the test liquid. After the reversion for 10 minutes, the degree of foaming was measured at 25° C.

TABLE 1

| Neutralization degree | pH | Foaming power |
|---|---|---|
| 0 | 3.4 | 0 ml |
| 0.1 | 5.0 | 15 |
| 0.2 | 5.6 | 85 |
| 0.4 | 6.3 | 190 |
| 0.6 | 6.5 | 170 |
| 0.8 | 6.7 | 170 |
| 0.9 | 8.0 | 95 |
| 1.0 | 10.5 | 0 |

From the results shown in Table 1, it is understood that the foaming power is excellent when the pH of 0.5% aqueous solution is in the range of 5.5–8.0, particularly in the range of 6.0–7.0.

EXAMPLE 2

The relationship between the concentration of a $C_{12}$ alkenylsuccinic acid adjusted to pH 6.6 with sodium hydroxide and the foaming power thereof in the presence of an oil was examined. The results are shown in Table 2.

TABLE 2

Relationship between concentration of sodium alkenylsuccinate (pH 6.6) and foaming power thereof

| Conc. (wt %) | Foaming (Volume of foams, ml) |
|---|---|
| 0.5 | 170 |
| 0.4 | 185 |
| 0.3 | 195 |
| 0.2 | 180 |
| 0.1 | 0 |

It is understood from Table 2 that when the concentration is reduced to 0.1 wt. %, the foams disappear rapidly. This fact indicates that the foams are removed rapidly in the rinsing step to exhibit a high rinsing effect.

EXAMPLE 3

A mixture of alkenylsuccinic acids of $C_{12}$ and $C_{14}$ ($C_{12}/C_{14}=57/43$) was neutralized with various bases to pH 6.6. The foaming powers of 0.3 wt. % solutions of them in the presence of an oil were examined to obtain the results shown in Table 3.

TABLE 3

Relationship between counter ion of alkenylsuccinic acid salt and foaming power thereof in the presence of oil

| Base used for the neutralization | Foaming (Volume of foams, ml) |
|---|---|
| LiOH | 175 |
| NaOH | 195 |
| KOH | 185 |
| $Mg(OH)_2$ | 0 |
| monoethanolamine | 180 |

TABLE 3-continued

| Relationship between counter ion of alkenylsuccinic acid salt and foaming power thereof in the presence of oil | |
|---|---|
| Base used for the neutralization | Foaming (Volume of foams, ml) |
| triethanolamine | 190 |

It is understood from Table 3 that the alkali metal salts and alkanolamine salts exhibit high foaming properties.

EXAMPLE 4

Foaming powers of 0.3 wt. % solutions of triethanolamine salts (pH 6.6) of alkenylsuccinic acids of various carbon numbers and an alkylsuccinic acid in the presence of an oil were determined. The results are shown in Table 4.

TABLE 4

| Surfactant | | | Foams (Volume of foams, ml) |
|---|---|---|---|
| $C_{12}$ | Alkenylsuccinic acid | | 180 |
| $C_{14}$ | " | | 190 |
| $C_{16}$ | " | | 195 |
| $C_{18}$ | " | | 100 |
| $C_{124}$ | " | Note 1 | 190 |
| $C_{168}$ | " | Note 2 | 190 |
| $C_{12}$ | Alkylsuccinic acid | | 175 |

Note 1 Mixture of $C_{12}$ and $C_{14}$ ($C_{12}/C_{14}$ = 57/43)
Note 2 Mixture of $C_{16}$ and $C_{18}$ ($C_{16}/C_{18}$ = 20/80)

It is understood from Table 4 that fully satisfactory foaming powers are obtained irrespective of carbon number or of the difference between alkenyl and alkyl groups. Foaming power of $C_{18}$ alkenylsuccinic acid is far inferior, since the solubility thereof is poor.

EXAMPLE 5

Sodium $C_{12}$ alkenylsuccinate (pH=6.6) was mixed with various surfactants in a weight ratio of 1/1. The foaming powers of 1 wt. % solutions of the mixtures in the presence of an oil were examined. The results are shown in Table 5.

TABLE 5

| Surfactant mixed | Foaming (Volume of foams, ml) |
|---|---|
| Triethanolammonium salt of dodecylsulfate | 195 |
| Sodium polyoxyethylene ($\bar{p}$ = 3) dodecyl ether sulfate | 190 |
| Miranol-C2M Note 1 | 190 |
| Dimethyldodecylamine oxide | 185 |
| N-dodecylbetaine | 190 |

Note 1 Ampholytic surfactants of imidazoline type (a product of Miranol Chemical Co., U.S.A.)

It is understood from the results shown in Table 5 that a sufficient foaming power can be obtained even if sodium $C_{12}$ alkenylsuccinate is used in the form of a mixture with an anionic or ampholytic surfactant.

EXAMPLE 6

| | |
|---|---|
| Mixture of $C_{12}/C_{14}$ alkenylsuccinic acids ($C_{12}/C_{14}$ = 57/43) | 15 parts by weight |
| Triethanolamine | 7.6 |
| Perfume | 0.1 |
| Ion-exchanged water | ad 100.0 parts |

-continued

| | by weight |
|---|---|

A liquid detergent (pH 6.6) of the above composition was distributed to 10 housewives and a pair of comparison test with commercially available detergent A (sodium alkylbenzenesulfonate) was effected. The results are shown in Table 6.

TABLE 6

| | Detergent of the present invention is superior | The two detergents are equivalent | The commercially available detergent is superior |
|---|---|---|---|
| Foaming property | 1 | 7 | 2 |
| detergency | 3 | 5 | 2 |
| Removal of foams in the rinsing step | 8 | 2 | 0 |

It is apparent from the results of the questionnaire that the detergent of the present invention is equivalent to the commercially available detergent with respect to detergency and foaming power and that the former has a merit of immediate removal of foams in the rinsing step.

EXAMPLE 7

| composition: | |
|---|---|
| triethanolamine salt of tetradecenyl succinic acid (0.5% aqueous solution having pH of 7.0) | 67.9 wt. % |
| stearyl alcohol | 6.0 |
| sodium laurylphosphate (0.5% aqueous solution having pH of 7.0) | 15.0 |
| pigment | 0.1 |
| perfume | 1.0 |
| water | 10.0 |

The above mentioned composition was heated and melted. Then it was introduced into a mold to prepare a Syndet bar (detergent bar) therefrom. A hand-washing test indicated that the Syndet bar was excellent in respect to foaming property and comfortable when used.

EXAMPLE 8

| composition: | |
|---|---|
| partially neutralized diethanolamine salt of tetradecenylsuccinic acid (its 0.5% aqueous solution having a pH of 6.5) | 15.0 wt. % |
| partially neutralized diethanolamine salt of decylsuccinic acid (its 0.5% aqueous solution having a pH of 6.5) | 20.0 |
| partially neutralized diethanolamine salt of hexadecylsuccinic acid (its 0.5% aqueous solution having a pH of 6.5) | 4.0 |
| glycerin | 10.0 |
| sugar | 15.0 |
| ethanol | 15.0 |
| pigment | trace |
| perfume | 1.0 |
| water | 20.0 |

The above mentioned composition was heated and melted, and then casted into a mold to prepare a Syndet bar. A hand-washing test indicated that it was found to be excellent as to the foaming property and comfortable when used.

What is claimed is:

1. A detergent composition containing from 3 to 95 wt. % of partially neutralized succinic acid derivative having the formula

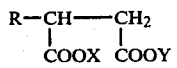

$$R-\underset{\underset{COOX}{|}}{CH}-\underset{\underset{COOY}{|}}{CH_2} \quad (1)$$

wherein R is a saturated or unsaturated hydrocarbon group having from 8 to 18 carbon atoms, and X and Y are each hydrogen, an alkali metal, ammonium or an alkanolamine, with the proviso that from 0.2 to 0.9 equivalents of the groups COOX and COOY are alkali metal, ammonium or alkanolamine carboxylate groups and the remainder are carboxyl groups;

the balance of said detergent composition being conventional ingredients of liquid or granular detergents, said ingredients being different from said derivative, with the provisos that said detergent composition is free of alkaline builder and an aqueous solution of said detergent composition containing 0.5 wt. % of said derivative has a pH of 5.5 to 8.0.

2. A detergent composition according to claim 1 which is a liquid containing 3 to 50 wt. % of said partially neutralized succinic acid derivative.

3. A detergent composition according to claim 1 which is a solid containing 30 to 95 wt. % of said partially neutralized succinic acid derivative.

4. A detergent composition according to claim 2 which contains 10–40 wt. % of said partially neutralized succinic acid derivative.

5. A detergent composition according to claim 1, claim 2, claim 3 or claim 4 in which said aqueous solution has a pH of 6.0 to 7.0.

6. A detergent composition according to claim 1, claim 2, claim 3 or claim 4 wherein R is an unsaturated hydrocarbon group having from 10 to 16 carbon atoms.

7. A detergent composition according to claim 5 wherein R is an unsaturated hydrocarbon group having from 10 to 16 carbon atoms.

* * * * *